US006808158B2

(12) United States Patent
Schwarz

(10) Patent No.: US 6,808,158 B2
(45) Date of Patent: Oct. 26, 2004

(54) HYDRAULIC OUTLET-VALVE ACTUATION AND METHOD OF MAKING AND USING SAME

(75) Inventor: Volker Schwarz, Weinstadt (DE)

(73) Assignee: DaimlerChrysler AG, Stuttgart (DE)

( * ) Notice: Subject to any disclaimer, the term of this patent is extended or adjusted under 35 U.S.C. 154(b) by 164 days.

(21) Appl. No.: 10/307,496

(22) Filed: Dec. 2, 2002

(65) Prior Publication Data

US 2003/0107014 A1 Jun. 12, 2003

(30) Foreign Application Priority Data

Nov. 30, 2001 (DE) ..... 101 58 873

(51) Int. Cl.[7] ..... F16K 31/383
(52) U.S. Cl. ..... 251/63.4
(58) Field of Search ..... 251/62–63.6

(56) References Cited

U.S. PATENT DOCUMENTS 3,608,859 A * 9/1971 Hetzer ..... 251/63.4
4,471,941 A * 9/1984 Sims ..... 251/63
5,029,609 A * 7/1991 Blok ..... 137/492.5
5,165,369 A * 11/1992 Rembold et al. ..... 123/90.12
6,520,066 B2 * 2/2003 Skirde et al. ..... 92/12.2

FOREIGN PATENT DOCUMENTS

DE 195 42 561 11/1996
GB 2 265 419 9/1993

* cited by examiner

*Primary Examiner*—Paul J. Hirsch
(74) *Attorney, Agent, or Firm*—Crowell & Moring LLP

(57) ABSTRACT

A hydraulic valve control arrangement is provided with a control line of a control cylinder, the control line being connected to a first oil volume, with a first control piston having a first control face and operatively connected to the first oil volume, and with a plunger piston which is arranged between the first control piston and an outlet valve and has a second control face and which is operatively connected to a second oil volume. A first control edge is provided between the control cylinder and the first control piston. The control edge switches a first throughflow connection between the first oil volume and the second oil volume operatively connected to a third control face of the first control piston.

29 Claims, 4 Drawing Sheets

HYDRAULIC OUTLET-VALVE ACTUATION AND METHOD OF MAKING AND USING SAME

BACKGROUND AND SUMMARY OF THE INVENTION

This application claims the priority of German Patent Document DE 101 58 873.9, filed on Nov. 30, 2001, the disclosure of which is expressly incorporated by reference herein.

The invention relates to a hydraulic valve control arrangement with a control line of a control cylinder, said control line being connected to a first oil volume, with a first control piston having a control face A1 and operatively connected to the first oil volume, and with a plunger piston which is arranged between the first control piston and an outlet valve and has a control face A2 and which is operatively connected to a second oil volume.

A hydraulic valve control is already known from German Patent Document DE 195 42 561 C1, having preferably two pistons which are separated from one another and act selectively on the valve and which are connected to a high-pressure accumulator. In this case, the piston arrangement is capable of being acted upon by fuel maintained at a different pressure level, and, at the end of the opening operation and during the closing operation, the moved mass can be reduced. To open the valve, the piston arrangement is acted upon by fuel of higher pressure and, for closing, is acted upon by fuel of lower pressure. Two different pressure levels of the pressure accumulator or pressure accumulators are therefore necessary.

In particular British Patent Document GB 2 265 419 A describes a piston arrangement of a compression brake, having a telescopically connected piston arrangement in which a first volume delimited via a plunger piston bearing against a rocker is acted upon by excess pressure. In this case, an actuating force of the actual displacement piston is generated counter to the closing force of the valves, the actuating force ultimately resulting in the opening of the valves. The piston arrangement is integrated at any time into the force flux of the rocker. There is no provision for a gradation of the actuating force.

An aspect of certain preferred embodiments of the invention is to design and arrange a hydraulic valve control device in such a way that different actuating forces are ensured by way of one pressure level.

This aspect can be achieved, according to certain preferred embodiments of the invention, in that a first control edge, switching the first throughflow connection from the first oil volume to the second oil volume operatively connected to a control face A3 of the first control piston, is provided between the control cylinder and the first control piston. Thereby the second oil volume is cut in by the control edge after a defined displacement S1 of the control piston and a counterforce F3 to the current actuating force F1 is generated according to the arrangement of the control face A1 and control face A2 or according to their face ratio. Thus, during the second part of the valve stroke, the valve-opening force decreases according to the control-face ratios, and increased wear on the materials and also an overshoot of the outlet valve are avoided.

For this purpose, it is advantageous that, starting from a neutral position of the first control piston, the first throughflow connection is opened after a displacement S1 of the first control piston or of the first control edge. It is therefore unimportant whether the control edge or the control piston executes the displacement S1 so that the throughflow connection is opened.

Furthermore, it is advantageous that the control face A3 is arranged opposite the control face A1 and the control face A2, opposite control faces being acted upon by oil pressure generating opposed actuating forces. Thus, the control face A3 generates an actuating force opposed to the control face A1 and control face A3.

Moreover, a solution is achieved in that a first control edge switching the first throughflow connection from the first oil volume to the control face A1 of the first control piston is provided between the control cylinder and the first control piston or a second control piston. Thereby the control face A1 is cut in by the first control edge after an initial displacement S0. The cut-in control face A1 also generates a corresponding control force F1 which then assists the operation of opening the outlet valve.

For this purpose, it is advantageous that the first control piston or a second control piston has a control face A0, which is operatively connected to the first oil volume during the displacement S0, and the first control edge closing the first oil volume. Consequently, the oil volume is closed with respect to the control face A1 during the displacement S0 and is throughflow-connected to the smaller control face A0. Accordingly, only a control force F0 corresponding to the control face A0 is generated over the initial displacement S0 and is then increased to F1 by the operation of opening the control face A1.

It is also advantageous, for this purpose that, after the displacement S0, the first control edge is in a position opening the first oil volume, a first throughflow connection from the first oil volume to the control face A1 being provided after the displacement S0. After the displacement S0, the control face A1 is acted upon by oil pressure by the first throughflow connection, so that, from this point in time, an increased control force F1 is available.

Finally, according to a preferred embodiment, there is provision for a second throughflow connection designed as a throttle to be provided between the first oil volume and the control face A1. Thus, even before the end of the displacement S0, an oil pressure is exerted on the control face A1, so that, in this position, an actuating force arises via the control face A1 according to the throttle cross section or to the prevailing oil pressure.

It is particularly advantageous that the displacement S0 corresponds to a valve clearance and the displacement S1 corresponds to an opening displacement of the outlet valve, the opening displacement being between 5% and 50%, in particular between 10% and 20%, of the total valve displacement SG, and the displacement S2 constituting a displacement which completes the total valve displacement SG. By virtue of the existing pressure-space conditions or of the valve-actuating device, an optimum distribution of the actuating force to the outlet valve can be ensured. The valve-clearance compensating stroke requires a low actuating force, and the first part of the opening stroke of the outlet valve requires the highest actuating force, since the outlet valve has to be opened counter to the highly compressed combustion-space gases. After opening, and over the last part of the opening stroke, a low actuating force is again required, since, at this point in time, the combustion space is already depressurized.

In connection with the design and arrangement according to certain preferred embodiments of the invention, it is advantageous that, after the displacement S1, the control face A0 is operatively connected to the first oil volume, and a second control edge closing the first oil volume via the displacement S2 is provided. This ensures a reduction of the effective control face A1 to the control face A0, so that the completion stroke S2 is executed with a lower actuating force.

It is advantageous, furthermore, that the first control piston or the second control piston has the first control edge and/or the second control edge, after the displacement S0 the first control edge being operatively connected to a first control groove of the control cylinder, and after the displacement S2 the second control edge being operatively connected to a second control groove of the control cylinder. The control piston can therefore have a one-part or two-part design, the necessary control edges and the control grooves which correspond to them being provided, within the control-piston wall, on the second or on the one control piston.

Moreover, it is advantageous that the second control piston is arranged upstream of the first control piston in the displacement direction and/or the first control piston has a first return element, such as a spring, which acts counter to the actuating force F1 and which generates a return force F Ü. The control piston is returned into the initial position after the opening stroke by way of the spring.

Furthermore, it is advantageous that the face ratios A1/A2 and A1/A0 are between two and ten, in particular between three and five, and the control face A1 is equal to the control face A3. The force ratio of the individual opening displacements is defined by the face ratios.

Consequently, in addition, the transmission ratio of the two control pistons is also defined during the displacement S2, since, in the case of a constant oil volume flow (dV/sec), the displacement (ds) of the second control piston is directly proportional to its piston cross-sectional area. While the second control piston is moving by the amount of ds2=dV/A0, the first control piston can move only by the amount ds1=dV/A1 (A1>A0→ds2<ds1), since the oil volume between the two pistons is closed. However, since the second control piston bears against the first control piston, a vacuum arises in the second oil volume.

Finally, it is advantageous that the first oil volume and the control face A1 of the first control piston are acted upon by oil pressure via the control line, a control force F1 is generated and the first control piston is set in displacement motion, at the same time, the plunger piston, which bears against the first control piston, and the outlet valve being set in motion counter to the valve-spring force FV. After the displacement S1 of the first control piston, the first throughflow connection to the second oil volume is opened via the first control edge, the outlet valve being opened by the amount of the displacement S1 via the plunger piston by way of the first control piston. The control face A3 is acted upon by oil pressure via the second oil volume and a counterforce F3 to the control force F1 is generated, and an additional return force FU to the counterforce F3 is generated by way of the first return element, at the same time, the control face A2 of the plunger piston being acted upon by oil pressure and a completing control force F2 of the plunger piston being generated. By way of the resulting control force FR=F1+F2−F3 (−FU), the outlet valve is opened completely, FR≧F2 being applicable in this case.

Finally, within the framework of certain preferred embodiments, it is advantageous that, in the neutral position, first the control face A0 and the first oil volume of the first control piston are acted upon by oil pressure via the control line, a control force F0 being generated and the first control piston being set in displacement motion. After a displacement S0 of the first control piston, the first throughflow connection from the first oil volume to the control face A1 is opened via the first control edge, and the control force F1 is generated, in the neutral position, the control face A1 being acted upon by oil pressure, starting from the first oil volume, via the throttle-like second throughflow connection. After a displacement S1, the first oil volume is closed by the second control edge and the control face A1 is partitioned off, and, consequently, the first oil volume and the control face A0 are then acted upon by oil pressure via the control line, and the control force F0 is generated. By way of the resulting control force FR=F0−FU, the outlet valve is opened completely, F0≧FU being applicable in this case.

Other objects, advantages and novel features of the present invention will become apparent from the following detailed description of the invention when considered in conjunction with the accompanying drawings.

DETAILED DESCRIPTION OF THE DRAWINGS

Figure 1:
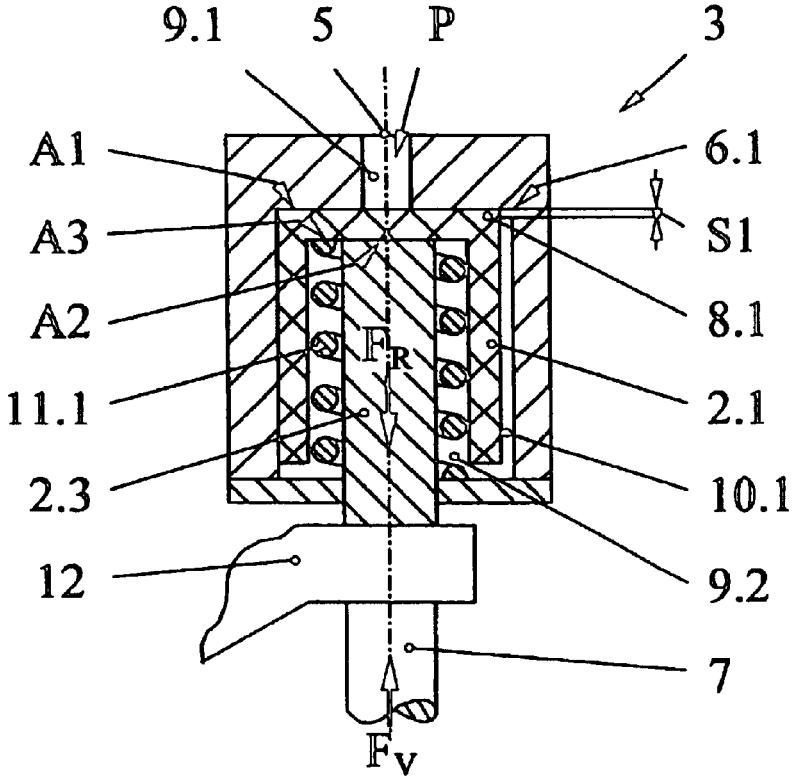
FIG. 1 shows a sectional illustration of a control cylinder with a first control piston and a plunger piston in the initial position.

FIG. 1 shows a control cylinder 3 with a control line 4. The control line 5 supplies a first oil volume 9.1 which is throughflow-connected to a second oil volume 9.2 via a first throughflow connection 10.1. Within the control cylinder 3 is arranged a first control piston 2.1 which separates the first oil volume 9.1 from the second oil volume 9.2. A plunger piston 2.3 is provided between the first control piston 2.1 and a drag lever 12 or an outlet valve 7. For this purpose, the first control piston 2.1 has a bowl-shaped design and bears coaxially against one end face of the plunger piston 2.3. In addition to the plunger piston 2.3, arranged within the first control piston 2.1, is a first return element 11.1 in the form of a spring, which presses the first control piston 2.1 upwards according to FIG. 1 or forms a return force.

Figure 2:
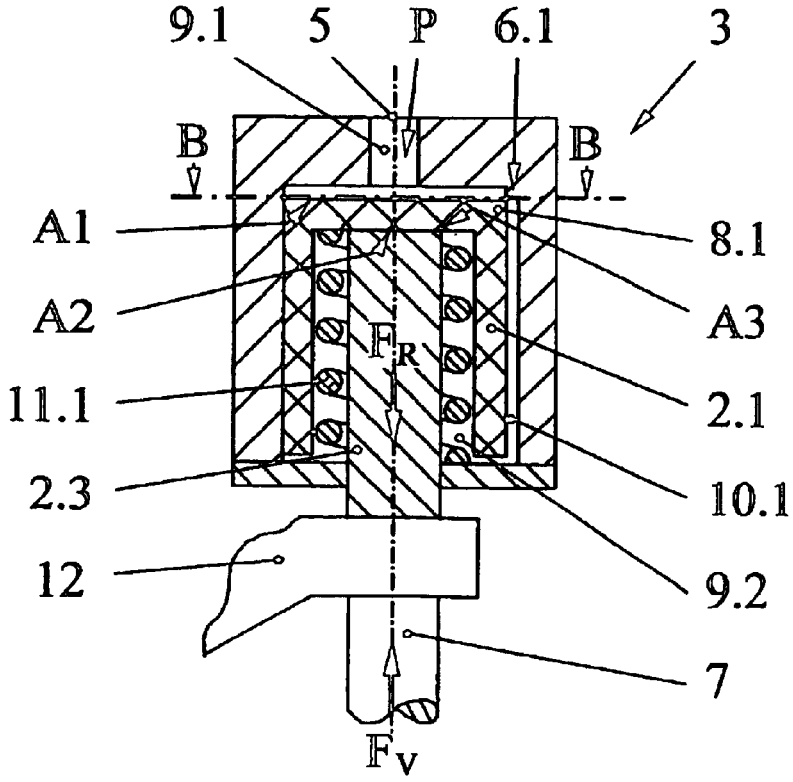
FIG. 2 shows a sectional illustration of a control cylinder with a first control piston and a plunger piston after a displacement S1.

The first control piston 2.1 has a first control edge 8.1. The first control edge 8.1 is assigned a first control groove 6.1 within the control cylinder 3. After a displacement S1 of the first control piston 2.1 or of the first control edge 8.1, the first throughflow connection 10.1 from the first oil volume 9.1 to the second oil volume 9.2 is opened as shown in FIG. 2. The actuating force ensuring this opening operation is generated, starting from a control pressure P of the control line 5, by way of the control face A1 of the first control piston 2.1. As soon as the first throughflow connection 10.1 is opened after the displacement S1, the second oil volume 9.2 is acted upon by oil pressure. A counterforce F3 is thus generated via the control face A3 of the first control piston 2.1. In addition, the control face A2 of the plunger piston 2.3 is acted upon by oil pressure, so as to give rise to an actuating force F2 which is directed downwards in the direction of motion according to FIG. 1 and which opens the outlet valve 7 via the drag lever 12.

In this case, the displacement S1 constitutes the first part of an opening cycle of the outlet valve 7, after which displacement the combustion-space pressure falls considerably, so that the resulting actuating force FR=F1−F3+F2 is sufficient to open the outlet valve 7 completely.

Figure 3:
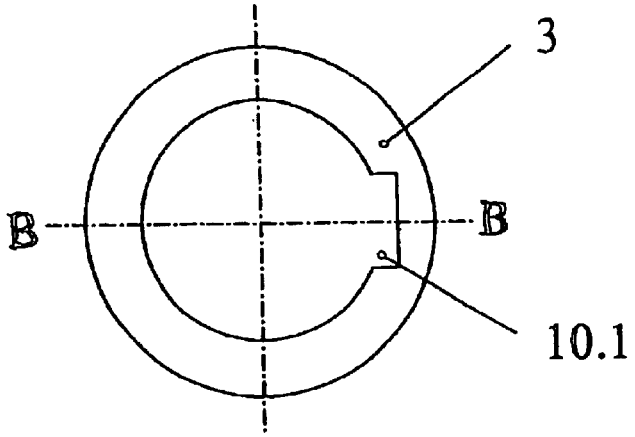
FIG. 3 shows a sectional illustration of a control cylinder from above, with a first throughflow connection.

The control cylinder 3 with the first throughflow connection 10.1 in the form of a groove is shown in FIG. 3 according to the section B—B from FIG. 2.

Figure 4:
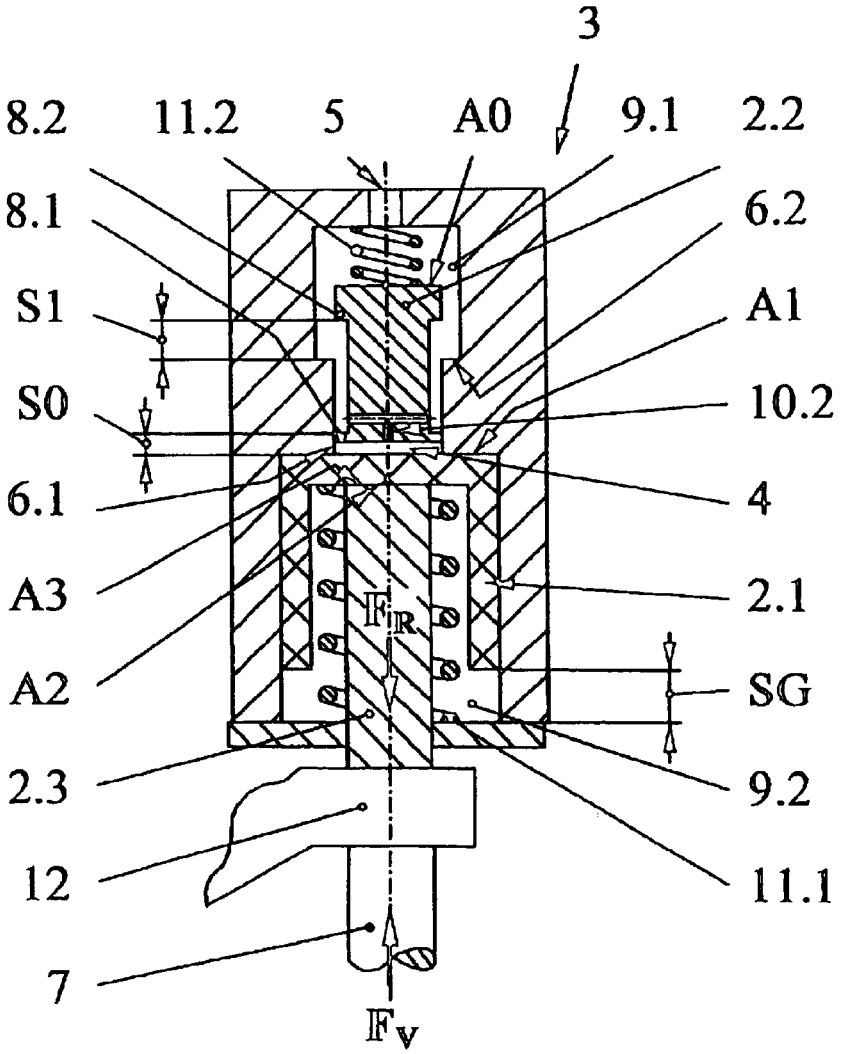
FIG. 4 shows a sectional illustration of a control cylinder with the first control piston, the plunger piston and a second control piston in the initial position.

FIG. 4 shows a further exemplary embodiment, in which, in addition to the first control piston 2.1 and the plunger piston 2.3, a second control piston 2.2 is provided above the first control piston 2.1. The second control piston 2.2 has a first control edge 8.1 and a second control edge 8.2 which are assigned to a first control groove 6.1 and a second control groove 6.2, respectively.

Figure 5:
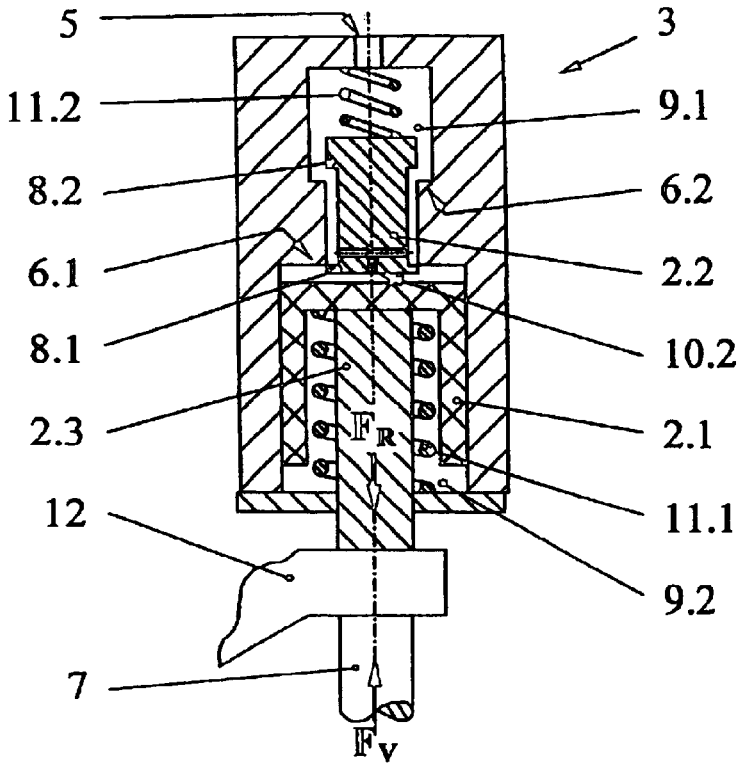
FIG. 5 shows a sectional illustration of a control cylinder with the first control piston, the plunger piston and the second control piston after a displacement S0.
Figure 6:
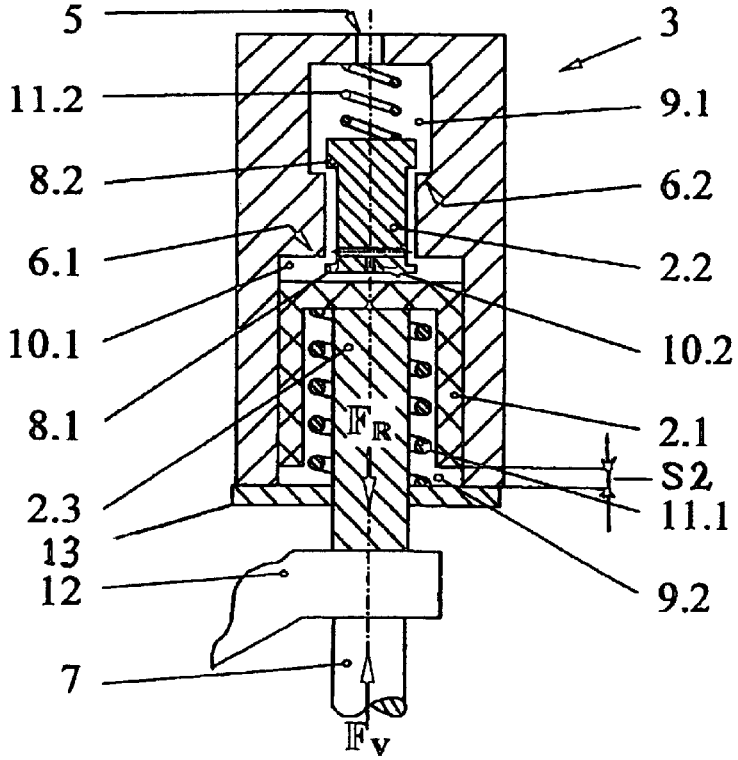
FIG. 6 shows a sectional illustration of a control cylinder with the first control piston, the plunger piston and the second control piston after a displacement S1.

In the initial position as shown in FIG. 4, the second control piston 2.2 or its control face A0 is acted upon by oil pressure, so that the control piston moves downwards by virtue of the generated actuating force F0. After a displacement S0, the first control edge 8.1 passes the first control groove 6.1, so that, as shown in FIG. 5, a first throughflow connection 10.1 is made from the first oil volume 9.1 to the control face A1 of the first control piston 2.1 (see FIG. 6). In addition to this first throughflow connection 10.1, as shown in FIG. 6, a second through-flow connection 10.2 in the form of a throttle is provided within the second control piston 2.2. Thus, as shown in FIG. 4, in the initial position a second throughflow connection 10.2 is made from the first oil volume 9.1 to the control face A1 of the first control piston 2.1. Depending on the oil flow and the throughflow quantity, the throttle generates an actuating force for the first control piston 2.1 before the first control edge 8.1 passes the first control groove 6.1 and the actual first throughflow connection 10.1 is opened.

According to FIG. 6, the second control piston 2.2 is in pressure equilibrium. Via a second return element 11.2, the control piston is pressed against the first control piston 2.1 or its control face A1 or comes to bear there. Via the control face A1 of the first control piston 2.1, the control face then being throughflow-connected to the first oil volume 9.1, the actuating force F1 is generated, which opens the outlet valve 7 further via the plunger piston 2.3 and the drag lever 12.

Figure 7:
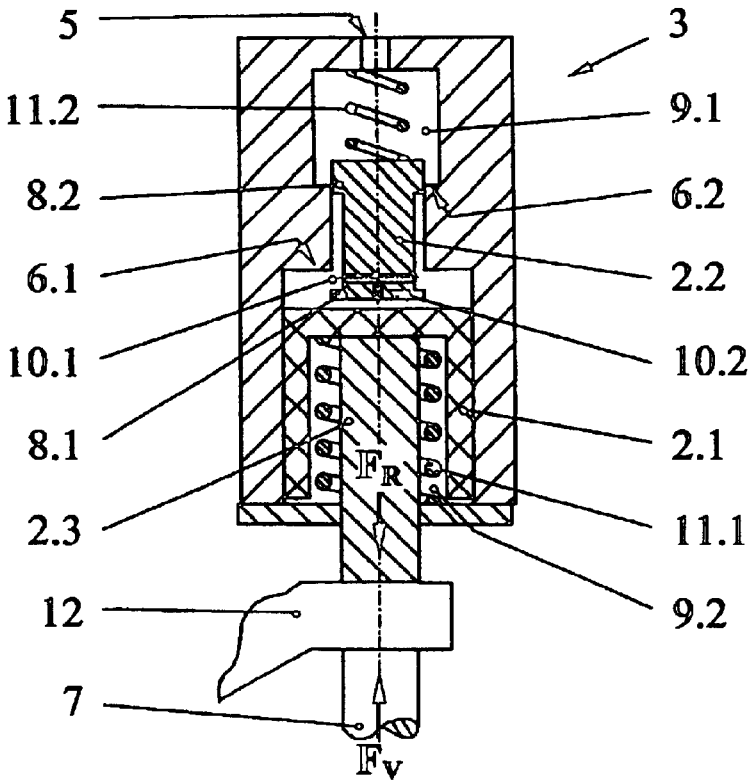
FIG. 7 shows a sectional illustration of a control cylinder with the first control piston, the plunger piston and the second control piston after a displacement S2.

As shown in FIG. 7, the first oil volume 9.1 is closed again after a displacement S1 (see FIG. 4), so that the control face A1 is switched to being pressure-free or has no throughflow connection to the first oil volume 9.1. By way of the control face A0 of the second control piston 2.2 (see FIG. 4), the control face A0 then being connected to the first oil volume 9.1, a control force F0 of the second control piston 2.2 remains and is conducted via the first control piston 2.1, the plunger piston 2.3 and the drag lever 12 of the outlet valve 7.

The displacement S0 in this case corresponds to the valve clearance, for the displacement of which a lower actuating force F0 is available. The displacement S1 during which the control face A1 is acted upon, corresponds to a first opening stroke of the outlet valve 7, for which an increased actuating force is ensured on account of the combustion-space pressure, and the displacement S2 corresponds to a completion displacement for the total stroke SG of the outlet valve 7.

After this displacement S1 or the first part of the opening stroke, the effective control face decreases from the control face A1 to the control face A0, so that a correspondingly low actuating force is generated, which is sufficient to open the outlet valve 7 completely via the displacement S2.

Figure 8:
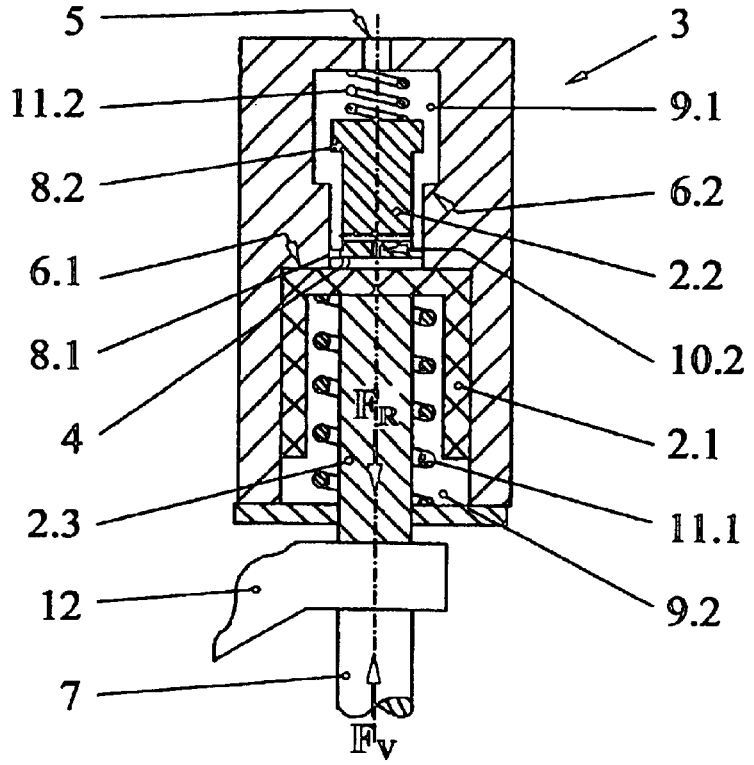
FIG. 8 shows a sectional illustration of a control cylinder with the first control piston, the plunger piston and the second control piston in the retracted state.

As shown in FIG. 8, the outlet valve 7 and the first control piston 2.1, together with the plunger piston 2.3 and the second control piston 2.2, are returned into the initial position via the valve spring, not illustrated, and the first return element 11.1.

As shown in FIG. 4, the second throughflow connection 10.2 is designed as a throttle which has a coaxial bore and a relief groove 4 in the diametral direction.

The control cylinder 3 has in addition to the control line 5, on the opposite side, a closing plate 13 which at the same time forms an abutment for the first control piston 2.1. This abutment determines the total displacement SG=S0+S1+S2 of the control-piston arrangement and therefore the opening displacement of the outlet valve 7.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Hydraulic valve control arrangement comprising:

a control line of a control cylinder, the control line being connected to a first oil volume, a first control piston having a control face A1 and operatively connected to the first oil volume, and a plunger piston which is arranged between the first control piston and an outlet valve and has a second control face A2 and which is operatively connected to a second oil volume, wherein a first control edge is provided between the control cylinder and the first control piston, the control edge switching a first throughflow connection between the first oil volume and the second oil volume which is operatively connected to a third control face A3 of the first control piston.

2. Hydraulic valve control arrangement according to claim 1, wherein, starting from a neutral position of the first control piston, the first throughflow connection is opened after a displacement S1 of the first control piston or of the first control edge.

3. Hydraulic valve control arrangement according to claim 1, wherein the third control face A3 is arranged opposite the first control face A1 and the second control face A2, opposite control faces acted upon by oil pressure generating opposed actuating forces.

4. Hydraulic valve control arrangement comprising:

a control line of a control cylinder, the control line being connected to a first oil volume, a first control piston having a first control face A1 and operatively connected to the first oil volume, and a plunger piston which is arranged between the first control piston and an outlet valve and having a second control face A2, wherein a first control edge is provided between the control cylinder and the first control piston or a second control piston, the first control edge switching a first throughflow connection from the first oil volume to the first control face A1 of the first control piston.

5. Hydraulic valve control arrangement according to claim 4, wherein the first control piston or the second control piston has a fourth control face A0, operatively connected to the first oil volume during a displacement S0, the first control edge closing the first oil volume.

6. Hydraulic valve control arrangement according to claim 2, wherein the first control piston has a fourth control face A0, operatively connected to the first oil volume during a displacement S0, the first control edge closing the first oil volume.

7. Hydraulic valve control arrangement according to claim 6, wherein, after the displacement S0, the first control edge is in a position opening the first oil volume, the first throughflow connection from the first oil volume to the first control face A1 being provided after the displacement S0.

8. Hydraulic valve control arrangement according to claim 5, wherein, after the displacement S0, the first control edge is in a position opening the first oil volume, the first throughflow connection from the first oil volume to the first control face A1 being provided after the displacement S0.

9. Hydraulic valve control arrangement according to claim 2, wherein a second throughflow connection designed as a throttle is provided between the first oil volume and the first control face A1.

10. Hydraulic valve control arrangement according to claim 5, wherein a second throughflow connection designed as a throttle is provided between the first oil volume and the first control face A1.

11. Hydraulic valve control arrangement according to claim 7, wherein a second throughflow connection designed as a throttle is provided between the first oil volume and the first control face A1.

12. Hydraulic valve control arrangement according to claim 5, wherein the displacement S0 corresponds to a valve clearance and a displacement S1 corresponds to an opening displacement of the outlet valve, the opening displacement being between 5% and 50% of a total valve displacement SG, and a third displacement S2 constituting a displacement which completes the total valve displacement SG.

13. Hydraulic valve control arrangement according to claim 6, wherein the displacement S0 corresponds to a valve clearance and the displacement S1 corresponds to an opening displacement of the outlet valve, the opening displacement being between 5% and 50% of a total valve displacement SG, and a third displacement S2 constituting a displacement which completes the total valve displacement SG.

14. Hydraulic valve control arrangement according to claim 5, wherein, after a displacement S1, the control face A0 is operatively connected to the first oil volume, and a second control edge closing the first oil volume via a displacement S2 is provided.

15. Hydraulic valve control arrangement according to claim 6, wherein, after the displacement S1, the control face A0 is operatively connected to the first oil volume, and a second control edge closing the first oil volume via a displacement S2 is provided.

16. Hydraulic valve control arrangement according to claim 7, wherein, after the displacement S1, the control face A0 is operatively connected to the first oil volume, and a second control edge closing the first oil volume via a displacement S2 is provided.

17. Hydraulic valve control arrangement according to claim 14, wherein the first control piston or the second control piston has at least one of the first control edge and the second control edge, after the displacement S0, the first control edge being operatively connected to a first control groove of the control cylinder, and after the displacement S2, the second control edge being operatively connected to a second control groove of the control cylinder.

18. Hydraulic valve control arrangement according to claim 15, wherein the first control piston has the first control edge, after the displacement S0, the first control edge being operatively connected to a first control groove of the control cylinder, and after the displacement S2, the second control edge being operatively connected to a second control groove of the control cylinder.

19. Hydraulic valve control arrangement according to claim 4, wherein the second control piston is arranged upstream of the first control piston in the displacement direction and the first control piston has a first return element which acts counter to an actuating force and which generates a return force.

20. Hydraulic valve control arrangement according to claim 2, wherein the first control piston has a first return element which acts counter to an actuating force and which generates a return force.

21. Hydraulic valve control arrangement according to claim 5, wherein face ratios A1/A2 and A1/A0 are between two and ten and the first control face A1 is equal to the third control face A3.

22. Hydraulic valve control arrangement according to claim 6, wherein face ratios A1/A2 and A1/A0 are between two and ten and the first control face A1 is equal to the third control face A3.

23. Method for moving a control piston, comprising:

acting upon a first oil volume and a first control face A1 of a first control piston by oil pressure via a control line, a control force F1 is generated and the first control piston is set in displacement motion, at the same time, setting in motion a plunger piston, which bears against the first control piston, and an outlet valve counter to a valve-spring force FV, after a displacement S1 of the first control piston, opening a first throughflow connection, to a second oil volume via a first control edge, opening a second outlet valve by an amount of the displacement S1 via the plunger piston by way of the first control piston, acting upon a third control face A3 by oil pressure via the second oil volume and a counterforce F3 to the control force F1 is generated, generating an additional return force FU to the counterforce F3 by way of a first return element, at the same time, acting upon a second control face A2 of the plunger piston by oil pressure and a completing control force F2 of the plunger piston is generated, and by way of a resulting control force $FR=F1+F2-F3\ (-FU)$, opening the outlet valve completely, $FR \geqq F2$ being applicable.

24. Method for moving a control piston, comprising:

in a neutral position, acting upon a first oil volume and a first control face A0 of the first control piston by oil pressure via a control line, a control force F0 is generated and the first control piston is set in displacement motion, after a displacement S0 of the first control piston, opening a first throughflow connection from the first oil volume to a second control face A1 via a first control edge, and a control force F1 is generated, in the neutral position, acting upon the second control face A1 by oil pressure, starting from the first oil volume, via a throttle-like second throughflow connection, after a displacement S1, closing the first oil volume by a second control edge and the second control face A1 is partitioned off, acting upon the first oil volume and the first control face A0 by oil pressure via the control line, and the control force F0 is generated, and by way of a resulting control force FR=F0−FU, opening the outlet valve completely, F0≧FU being applicable.

25. An actuation assembly, comprising:

a control cylinder with a control line, the control line being connected to a first oil volume, a control piston operatively connected to the first oil volume, the control piston having a first control face, a plunger piston being arranged between the control piston and an actuatable device, the plunger piston having a second control face and being operatively connected to a second oil volume, a throughflow connection operatively connecting the first oil volume and the second oil volume, the second oil volume being operatively connected to a third control face of the control piston, and a control edge provided between the control cylinder and the control piston, the control edge operatively switching the throughflow connection.

26. A method of making a hydraulic valve control arrangement comprising making the hydraulic valve control arrangement of claim 1.

27. A method of making a hydraulic valve control arrangement comprising making the hydraulic valve control arrangement of claim 4.

28. A method of using a hydraulic valve control arrangement comprising utilizing the hydraulic valve control arrangement of claim 1.

29. A method of using a hydraulic valve control arrangement comprising utilizing the hydraulic valve control arrangement of claim 4.

* * * * *